US006413329B1

(12) United States Patent
Nakatsu et al.

(10) Patent No.: US 6,413,329 B1
(45) Date of Patent: Jul. 2, 2002

(54) HIGH STRENGTH STEEL FOR DIES WITH EXCELLENT MACHINABILITY

(75) Inventors: Hideshi Nakatsu; Yasushi Tamura, both of Yasugi; Yoshiyuki Murakawa, Yonago, all of (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/982,903

(22) Filed: Oct. 22, 2001

Related U.S. Application Data

(63) Continuation of application No. 09/460,978, filed on Dec. 15, 1999.

(30) Foreign Application Priority Data

Feb. 12, 1999 (JP) ..... 11-033629

(51) Int. Cl.[7] ..... C22C 38/00

(52) U.S. Cl. ..... 148/333; 148/335; 420/108; 420/109; 420/112

(58) Field of Search ..... 148/333, 335; 420/108, 109, 112

(56) References Cited

U.S. PATENT DOCUMENTS

| | | | | |
|---|---|---|---|---|
| 3,944,442 | A | | 3/1976 | Donachie |
| 4,113,527 | A | * | 9/1978 | Larson et al. |
| 5,023,049 | A | | 6/1991 | Norstrom et al. ..... 420/91 |

FOREIGN PATENT DOCUMENTS

| | | | |
|---|---|---|---|
| JP | 54121219 | * | 9/1979 |
| JP | 60149744 | * | 8/1985 |
| JP | 3-75333 | | 3/1991 |
| JP | 3-501752 | | 4/1991 |
| JP | 5-70887 | | 3/1993 |
| JP | 6136490 | * | 5/1994 |
| JP | 7034196 | * | 2/1995 |
| JP | 7-278737 | | 10/1995 |
| JP | 8199310 | * | 8/1996 |
| JP | 10-36938 | | 2/1998 |
| SU | 412283 | | 1/1974 |
| WO | WO 89/05869 A | | 6/1989 |

OTHER PUBLICATIONS

G. Roberts, G. Krauss, R. Kennedy: "Tool Steels, 5$^{th}$ Ed" 1998, ASM International, USA, XP 002133043, pp. 291–304 JP63–76855.

Patent Abstracts of Japan, vol. 012, No. 301 (C–521), Aug. 16, 1988 & JP 63 –76855 A (Kawasaki Steel Corp), Apr. 7, 1988* table 1, example 12; p. 315, "S:0.02–0.3 wt%"* *abstract*.

G. Roberts, G. Krauss, R. Kennedy: "Tool Steels, 5$^{th}$ Edition" 1998, ASM International, USA XP002133043 * p. 291–p. 304 *.

Proceedings, A Joint U.S./ Japan Seminar Entitled: "Mechanical Behavior of Metals and Alloys Associated with Displacive Phase Transformations", Held at Rensselaer Polytechnic Institute Jun. 12–15, 1979, Sponsored Jointly by: National Science Foundation (U.S.), The Japan Society for the Promotion of Science.

* cited by examiner

*Primary Examiner*—Sikyin Ip
(74) *Attorney, Agent, or Firm*—Sughrue Mion, PLLC

(57) ABSTRACT

A high strength steel for dies has excellent machinability and including, by weight, 0.005 to 0.1% C, not more than 1.5% Si, not more than 2.0% Mn, from 3.0 to less than 8.0% Cr, not more than 4.0% Ni, 0.1 to 2.0% Al, not more than 3.5% Cu, and balance of Fe and unavoidable impurities including N and O, and which has a metal structure whose primary microstructure is martensite, wherein N and O as impurities are restricted to amount ranges of not more than 0.02% N and not more than 0.003% O. In the invention, an improvement in the machinability in heavy cutting an improvement in the precision electro discharge machining property and high-grade polishing property can be achieved when the above high strength steel has a chemical composition in which the value of (7.7×C (wt %))+(2.2×Si (wt %))+271.2×S (wt %)) is preferably not less than 2.5 and more preferably not more than 6.

16 Claims, 4 Drawing Sheets

(x400)

50 μm (x1000)

20 μm (x1000)

20 μm (x1000)

20 μm (x1000)

20 μm

HIGH STRENGTH STEEL FOR DIES WITH EXCELLENT MACHINABILITY

CROSS REFERENCE TO RELATED APPLICATIONS

This is a Continuation of Application Ser. No. 09/460,978 filed Dec. 15, 1999, the disclosure of which is incorporated herein by reference.

FIELD OF THE INVENTION

The present invention relates to a steel for dies having the martensitic microstructure which has high strength and excellent machinability.

TECHNICAL BACKGROUND OF THE INVENTION

Conventionally, a pre-hardened steel for dies has been known, which is used for molding plastics, for example. The pre-hardened steel for dies is adjusted to provide with a predetermined hardness and subsequently machined to obtain a die or the like as a final product without any further quenching treatment in contrast to a usual steel for dies, which is subjected to a process of annealing, machining and quenching to increase strength (or hardness) thereof.

Thus, although the pre-hardened steel can be provided with a high hardness which ensures high strength and high wear resistance thereby applicable to a product of die or the like, it is further required to have excellent machinability which is contradictory to the former property.

As disclosed in JP-A-5-70887, JP-A-7-278737, etc., for example, there have been known materials having the above properties, which are improved to provide high hardness by precipitation effect of additive Ni, Al, Cu or the like and adjusted to have bainitic microstructure having good machinability.

The pre-hardened steel, having a metal structure whose primary microstructure is bainite, is effective in realizing high hardness and relatively good machinability.

Thus, the pre-hardened steel is not required to be subjected to quenching treatment after working and is convenient to use for die manufacturers.

However, it is necessary to control the cooling rate in the heat-treatment process for adjusting the steel to have bainitic microstructure during manufacturing products of the steel and multiple heat-treatment steps are needed disadvantageously for such adjustment to bainitic microstructure. Further, recently there is a tendency for dies to be required to have corrosion resistance as well as high strength and longer life.

On the other hand, steels whose structural primary microstructure is martensite have been used in various applications making maximum use of particular properties of the steels, the properties can be obtained by comparatively high rate cooling treatment of transformation from austenite to martensite while avoiding existence of a phase of primary ferrite, pearlite or bainite.

There are known such types of steel being applied to dies, one example of which is shown in JP-A2-3-501752 and has a chemical composition which comprises 0.01 to 0.1% C, not more than 2% Si, 0.3 to 3.0% Mn, 1 to 5% Cr, 0.1 to 1% Mo, 1 to 7% Ni, and at least one of 1.0 to 3.0% Al and 1.0 to 4.0% Cu.

It has a microstructure of lath-martensite before aging and a hardness of 30 to 38 HRC, and can be readily subjected to subsequent heat-treatment in order to improve hardness.

However, also in the case of JP-A2-3-501752, it is not taken into consideration to machine a martensitic steel having a higher hardness exceeding 38 HRC.

This is because the martensitic microstructure is considered to have a problem in machinability and because machining after adjustment to martensite with increased hardness was inconceivable.

SUMMARY OF THE INVENTION

In order to solve the above problems, the object of the present invention is to provide a high strength steel which is improved in machinability without detriment to an advantageous property of excellent balance between strength and ductility, thereby the steel can be used for dies, especially those for molding plastics, as a pre-hardened material.

With regard to the steel, the present inventors examined a relationship between machinability and toughness and also corrosion resistance and found out that machinability can be greatly improved without detriment to toughness by adjusting the steel to have an optimum chemical composition to control the martensitic microstructure transferred from austenite when quenching and precipitation behavior of intermetallic compounds and carbides during quenching and tempering, thereby the invention has been proposed.

According to the invention, there is provided a high strength steel for dies having excellent machinability, which consists essentially of, by weight, 0.005 to 0.1% C, not more than 1.5% Si, not more than 2.0% Mn, from 3.0 to less than 8.0% Cr, not more than 4.0% Ni, 0.1 to 2.0% Al, not more than 3.5% Cu, and balance of Fe and inevitable impurities including nitrogen and oxygen, and which has a metal structure whose primary microstructure is martensite, wherein nitrogen and oxygen as impurities are restricted to amount ranges of not more than 0.02% nitrogen and not more than 0.003% oxygen.

According to the invention steel, it is possible to improve heavy cutting machinability, precision electrospark machining property and high-grade polishing property by making the steel to fulfill the value defined by the following equation:

$$\text{Value}=(7.7\times C(\text{wt }\%))+(2.2\times Si(\text{wt }\%))+(271.2\times S(\text{wt }\%))>2.5,$$

wherein the value is more preferably not more than 6.

The invention high strength steel may comprise optionally, by weight, not more than 1% Mo, not more than 1% Co, not more than 0.5% of at least one of V and Nb, and not more than 0.20% S.

DETAILED DESCRIPTION OF THE INVENTION

As mentioned above, there is provided a steel for dies which has excellent machinability and corrosion resistance and, more preferably, heavy cutting property, electro discharge machining property and polishing property by adjusting the steel to have an optimum chemical compositions, while having a hard and high strength martensitic microstructure.

Usually, the martensitic microstructure can be obtained by quenching treatment. However, because the invention steel comprises not less than 3% Cr, it easily transforms to martensite. Thus, it is also possible to obtain martensite by direct quenching in which the steel is cooled after hot working at a higher cooling rate than that of air cooling.

Particulars of the chemical composition of the invention steel are as follows.

C: 0.005 to 0.1%

A selected rather lower carbon level is important for ensuring the basic improvement in machinability of the invention steel. Lowering the carbon amount is effective for making the packet large, the packet being a unit of martensitic microstructure, and an important factor for improving machinability while the steel has hard martensitic microstructure.

Figure 1:
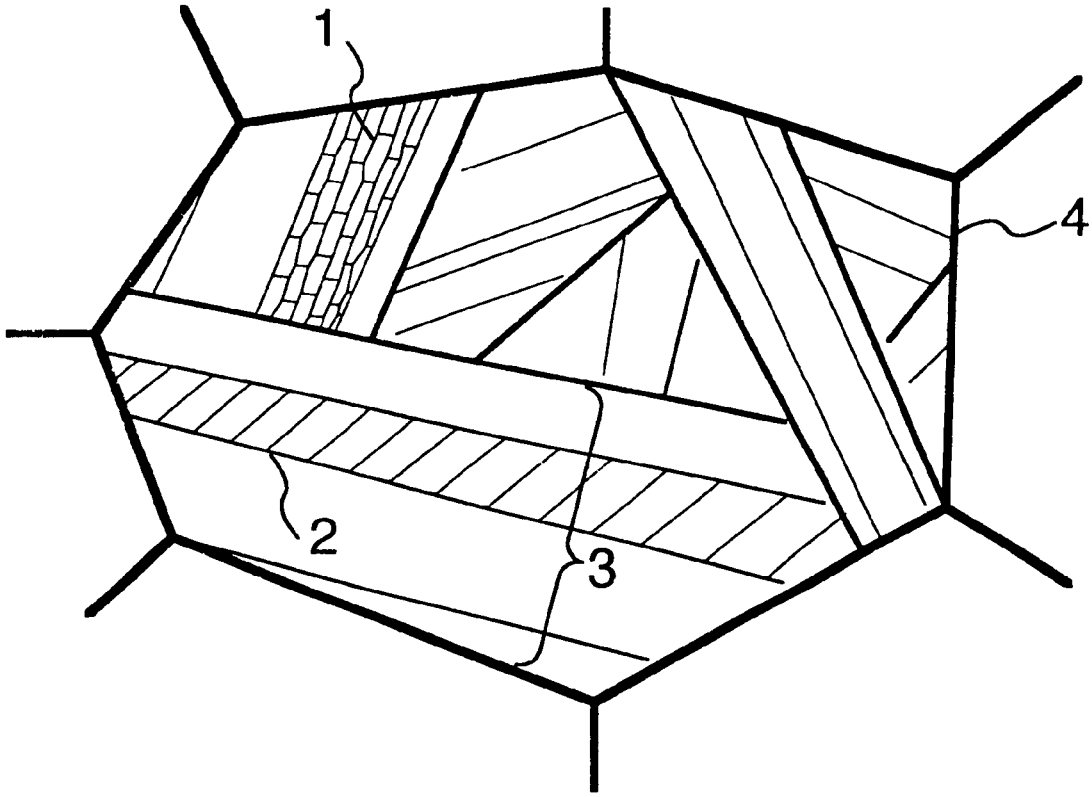
FIG. 1 schematically shows the metal microstructure of an invention steel.

Concretely, the present steel has such a microstructure as shown in FIG. 1 in which 1 denotes lath martensite, 2 a block, 3 a packet and 4 a prior austenite grain boundary, wherein one austenite grain is divided into several packets and each packet is further divided into several generally parallel strip-like blocks.

A packet is a region consisting of a group of many laths (lath-martensite) which align parallel to one another (that is, which have the same habit planes) and a block is a region consisting of a group of laths (lath-martensite) which are parallel to one another and have the same crystal orientation.

Thus, packets or blocks are of the basic structural units which are responsible for toughness of martensite. In the invention steel, it is believed that toughness is determined mainly by packets because the growth of blocks is insufficient. Concretely, the invention steel has the structure shown in FIG. 1.

When the carbon amount is lower, an amount of solute carbon is decreased and transformation strain is reduced, the strain occurs during transformation from austenite to martensite thereby decreasing combinations of packets which is formed as a strain relaxation mechanism. Because large packets lower the fracture stress during machining such as cutting, they reduces cutting resistance and improves the load on cutting tools. Thus, excellent machinability can be ensured even when the structure is hard martensite.

Further, carbon prevents formation of ferrite and is effective in improving hardness and strength. Carbon is needed to be in an amount of not less than 0.005%. When the carbon amount exceeds 0.1%, it forms carbides, which increase tool wear when cutting, or deteriorates corrosion resistance because of a decrease of a Cr amount in the matrix. Therefore, the carbon amount should be not more than 0.1%, more preferably, less than 0.05% in order to further improve machinability without detriment to the above function.

Cr: 3.0 to less than 8.0%

Cr is effective in imparting corrosion resistance to the steel and required to be in a limited amount in order for obtaining a metal structure having excellent machinability. When the Cr amount is less than 3% or not less than 8%, machinability is deteriorated because primary ferrite precipitates prior to the martensitic transformation. Further, because the solute carbon is brought into the matrix when the primary ferrite precipitates, the solute carbon increases in the matrix resulting in that transformation strain increases during the subsequent transformation of the remaining austenite to martensite.

For this reason, the above packet size becomes small, thereby deteriorating machinability.

Thus, in the invention steel, the Cr amount is limited to the range of from 3.0 or less than 8.0%, preferable from 3.5% to 7.0%.

N: Not more than 0.02%

The invention steel comprises Cr in a comparatively large amount of not less than 3.0%. An increase of the Cr amount increases the solubility of nitrogen in molten steel. For example, when the Cr amount is about 2%, the solubility limit of nitrogen is about 220 ppm at 1500° C. In the case of about 3% Cr, the solubility limit increases to 280 ppm. In the case of 5% Cr, the solubility limit exceeds 300 ppm.

Nitrogen (N) forms nitrides in steel. Especially in the case of a steel comprising Al, like as the invention steel, it is greatly deteriorated by AlN with regard to toughness, machinability and polishing property of dies made therefrom. In the invention steel comprising Cr, therefore, it is important to limit the nitrogen amount to a low level.

In the present invention, in order to further improve toughness, machinability and polishing property, the nitrogen amount is limited to not more than 0.02%, preferably not more than 0.005%, and more preferably not more than 0.002%.

O: Not more than 0.003%, preferably not more than 0.001%

Oxygen (O) forms oxides in steel. When the oxygen amount exceeds 0.003%, cold plastic workability and the polishing property are remarkably deteriorated. Therefore, the upper limit of oxygen amount is 0.003%. In order to improve the polishing property, the oxygen amount is preferably not more than 0.001%.

Si: Not more than 1.5%

Si is usually used as a deoxidizer. It improves also machinability while deteriorating toughness. Taking the balance between the both functions into consideration, the Si amount is preferably not more than 1.5%, more preferably, more than 0.05% and not more than 1.5% in order to improve hardness of the matrix without detriment to the balance between the above both functions.

Mn: Not more than 2.0%

Mn is a deoxidizer like as Si and has a function of preventing formation of ferrite by enhancing hardenability. However, an exceeding amount of Mn increases ductility so as to decrease machinability. Thus, the Mn amount is limited to not more than 2.0%.

Ni: 1.0 to 4.0%

Ni has functions of lowering the transformation temperature to uniformly form the primary martensitic microstructure when cooling and of forming and precipitating intermetallic compounds with Ni thereby increasing hardness. If the Ni amount is less than 1.0%, such functions can not be expected. Even if it exceeds 4.0%, the effects of Ni will not become significant for its amount. Further, Ni exceeding 4.0% forms austenite having excess toughness resulting in deteriorating machinability. Thus, the Ni amount is limited to 1.0 to 4.0%.

Al: 0.1 to 2.0%

Al has a function of combining with Ni to form nd precipitate an intermetallic compound of NiAl, thereby increasing hardness. In order to ensure the effect of the function, it is necessary that the Al amount be not less than 0.1%. However, even if the Al amount exceeds 2.0%, the effect of precipitation hardening cannot be expected in terms of the balance between Al and Ni. Moreover, Al exceeding 2.0% forms hard oxide system inclusions, causing tool wear and impairing the mirror finishing property, workability for providing an orange peel surface, etc. Therefore, the Al amount is limited to the range of from 0.1 to 2.0%. In order to restrain a decrease in softening resistance by ensuring stable hardness, the Al amount is preferably 0.5 to 2.0%.

Cu: Not more than 3.5%

Cu is considered to form a solid solution of the $\epsilon$ phase which comprises a small amount of Fe. Cu is responsible for precipitation hardening like as Ni. On the other hand, Cu decreases toughness and deteriorates hot workability by invading the grain boundaries of base metal at a high temperature. Therefore, the Cu amount is limited to not more than 3.5%. It is preferably 0.3 to 3.5%.

In the above basic composition range of the invention steel, there is no problem in machinability on a usual end mill, etc. However, the present inventors pushed forward investigations bearing in mind the application of this steel to heavy cutting, and found out that the value of "(7.7×C(wt %))+(2.2×Si(wt %))+(271.2×S(wt %))" is preferably not less than 2.5 and not more than 6.

Actually the inventors conducted a performance test for the invention steel under heavy cutting conditions, and found out that there can be obtained a combination of excellent toughness and machinability also in heavy cutting when the value of the above equation is not less than 2.5. The inventors also found out that there can be obtained a further combine of the property suitable for precision electro-spark machining and the polishing property when the value of the above equation is not more than 6. The factors, etc. of the equation were obtained from a regression analysis of experimental values.

To be more specific, the inventors confirmed that there is a singular phenomenon that in heavy cutting, for example, under the cutting condition that the area of cut into a material to be cut per tooth is not less than 50 $mm^2$, seizuring to the tool occurs, resulting in expiration of tool life, even within the specified composition range of the invention. Although the reason is unknown, it might be thought that such phenomenon is caused by a rise in the cutting temperature.

As a result of repeated experiments by the inventors, the desirable compositions capable of enduring even heavy cutting were obtained by adjusting the C, Si and S amounts. The above equation specifies the relationship of these amounts.

It might be thought that the C, Si and S amounts specified in the above equation have the following meanings for heavy cutting.

In the case of heavy cutting, the cutting temperature rises considerably high, and, therefore, Si forms oxides, having a low melting point, at the contact interface between the tool and at chips and prevents the material to be cut from seizuring to the tool by a lubrication effect of cut chips.

Sulfur is responsible for improving the lubrication effect of cut chips by forming sulfides, having a low melting point, and for improving a dividing property imparted by MnS. Moreover, because the cutting temperature is considerably high in heavy cutting, ductility and toughness of the material to be cut are high and it is very difficult to cut the material. Sulfur, which lowers ductility and toughness a little at a high temperature, can improve machinability.

Regarding carbon, chips are soon divided thereby preventing sticking to the tool.

Although the above ranges are desirable for preventing the sticking phenomenon in heavy cutting, toughness is decreased a little when the Si amount is much. In order to compensate for this, it is desirable to set the carbon amount at a somewhat high level. In consideration of this point, it is necessary that the preferred carbon amount when heavy cutting is applied be not less than 0.03% by weight, and that the Si amount be set at a little high range of from 0.8 to 1.5%.

Moreover, in a case where heavy cutting is applied, the machinability in heavy cutting is not so good with sulfur amount of less than 0.001%, and when the sulfur amount is not less than 0.01%, the property suitable for precision electro-spark machining is not good (deterioration of toughness and stripe defects due to MnS) and the high-grade polishing property is also not good because of occurrence of pits due to MnS. Therefore, when sulfur is to be added, its amount is preferably 0.001 to 0.01%. In addition, because sulfur increases crack sensitivity, it is desirable to limit the sulfur amount to, preferably, not more than 0.006% especially when electro-spark machining is performed.

Mo: Not more than 1.0%

Mo dissolved in the matrix to be very effective in improving corrosion resistance by strengthening a passive film. Moreover, Mo combines with carbon to form fine mixed carbides and is very effective in restraining coarsening of $M_7C_3$ type carbides, which are mainly formed from Cr. As a result, toughness is improved and factors responsible for the formation of pinholes are reduced. However, an excessive amount of Mo forms a large amount of carbides, increasing tool wear. Therefore, the upper limit of the Mo amount is 1.0%. More preferably, it is desirable to add not less than 0.1% Mo in order to ensure that the above effect is effectively produced.

Co: Not more than 1.0%

Co is dissolved in the matrix to improve properties of secondary hardening and corrosion resistance. Co restrains also coarsening of $M_7C_3$ type carbides, which are mainly formed from Cr, and finely precipitates these carbides and intermetallic compounds (Ni—Al) in the matrix, thereby improving toughness. However, an excess amount of Co brings the steel to be deteriorated in toughness, machinability and quenching property. For this reason and in economical consideration, the upper limit of Co amount is set at 1.0%. More preferably, Co is added in amounts of not less than 0.1% in order to ensure that the above effects are effectively obtained.

V and Nb: Not more than 0.5%

V and Nb are effective in refining crystal grains to improve the toughness of steel, thereby further improving the properties of the invention steel. Therefore, these elements may be optionally added.

Moreover, because V and Nb tend to combine with nitrogen to form fine nitrides, they can restrain deterioration in machinability, toughness and polishing property caused by coarse compounds due to the formation of AlN. Large amounts thereof form carbides, thereby increasing tool wear. Therefore, the upper limit of a total amount of V and Nb is set to 0.5%, more preferably, 0.01 to 0.1%.

S: Not more than 0.20%

Sulfur combines with Mn to form inclusions of MnS, thereby improving machinability. However, sulfur may be optionally added because MnS is liable to be a trigger point of pitting corrosion, deteriorating corrosion resistance. However, the upper limit of sulfur amount is set to 0.20% because an improvement in machinability which is commensurate with a decrease in corrosion resistance cannot be expected even if the sulfur amount exceeds 0.20%. Moreover, sulfur deteriorates the electro-spark machining property and polishing property as mentioned above, it is necessary to limit the amount of sulfur according to applications of the steel.

According to the invention steel, elements for improving toughness or machinability may be added in a range in which the basic functions resulting from the metal structure and the chemical composition stated are not impaired thereby.

For example, the invention steel may comprise, as elements for improving ductility, one or two kinds of elements selected from the group consisting of not more than 0.5% Ti, not more than 0.5% Zr, and not more than 0.3% Ta. It may also comprise, as elements for improving machinability, one or two kinds of elements selected from the group consisting of 0.003 to 0.2% Zr, 0.0005 to 0.01% Ca, 0.03 to 0.2% Pb, 0.03 to 0.2% Se, 0.01 to 0.15% Te, 0.01 to 0.2% Bi, 0.005 to 0.5% In, and 0.01 to 0.1% Ce. It may also a total amount of 0.0005 to 0.3% Y, La, Nd, Sm and other REMs.

EXAMPLE

The invention is explained in detail below with the aid of embodiments.

First, a standard manufacturing method for specimens is described. Specimen steels were melted in a 30-kg high-frequency vacuum melting furnace and after forging into square bars with a size of 40 mm×40 mm, the martensitic microstructure was obtained by subjecting the square bars to heat-treatment.

The heat-treatment was such that in order to obtain a hardness of 40 HRC ±5, quenching was performed by heating at 1,000° C. for 1 hour followed by air cooling, and tempering was performed thereafter by heating at an appropriate temperature of from 520 to 580° C. in increments of 20° C. followed by air cooling.

The packet size of martensite in actual measurement and evaluation was determined as an average packet size by first determining the size by comparing the optical microstructure of martensite with the standard size diagram of 100 magnification specified in ASTM and then carrying out these measurements for 6 photographs for each specimen. The higher the numerical value of packet size, the finer the packet.

To evaluate machinability, an end mill cutting test was carried out and the maximum wear width (Vbmax (mm)) on the tool flank at a cutting length of 6 m was measured. cutting was performed by the wet method on an end mill with two high-speed steel blades of 10 mm in diameter at a cutting speed of 23 m/min and a feed rate of 0.06 mm/tooth.

To evaluate toughness, the Charpy impact test was performed through the use of 2-mm U-notch test pieces (JIS No. 3 test pieces) and the Charpy impact value at room temperature was measured.

(1) The salt spray test (5% NaCl, 35° C., 1 hour) and (2) the tap-water immersion test (room temperature, leaving specimens in the air after immersion for 1 hour) were carried out as corrosion resistance tests. Rusting condition was compared by an appearance observation and rated according to the degree of rust as excellent (no rusting, ◎), good (percentage of rusted area: less than 10%, ○), no good (percentage of rusted area: not less than 30%, ×), and intermediate (percentage of rusted area: 10 to less than 30%, Δ).

To evaluate the polishing property, hardness was adjusted by subjecting specimens of 5 mm square to quenching and tempering and after that, mirror finishing was performed by the grinder-paper-diamond compound method, and the number of fine pits that occurred was counted with a magnifying glass of 10 magnification. Specimens were rated as good (○) when the number of pits was less than 10, as intermediate (Δ) when it was from 10 to 20, and as no good when it was more than 20(×).

Example 1

Steels which have the main components shown in Table 1 and in which the trace elements shown in Table 2 are detectable were produced by the above manufacturing method and their properties were evaluated. The results of the evaluation are shown in Table 3.

In invention specimens Nos. 1 to 6 of the invention, the Cr amount was varied within the specified range of the invention. Corrosion resistance tends to improve a little when the Cr amount is increased within the range of the invention. Machinability is best when the Cr amount is around 5%. No great difference is observed in toughness or the polishing property.

On the other hand, both in comparative specimen C3 in which the Cr amount is less than the specified range of the invention and in comparative specimen C4 in which the Cr amount is more than the specified range of the invention, the ferrite structure appeared and the machinability of these specimens was much inferior to that of the specimens of the invention.

In invention specimens Nos. 7 to 12, the carbon amount was varied within the specified range of the invention. Machinability tends to be deteriorated a little when the carbon amount is increased within the range of the invention. There is no great difference in corrosion resistance, toughness or the polishing property.

On the other hand, in comparative specimen C1 in which the carbon amount is higher than the specified range of the invention, corrosion resistance deteriorated in comparison with the invention specimens and, at the same time, machinability deteriorated greatly.

Figure 2A:
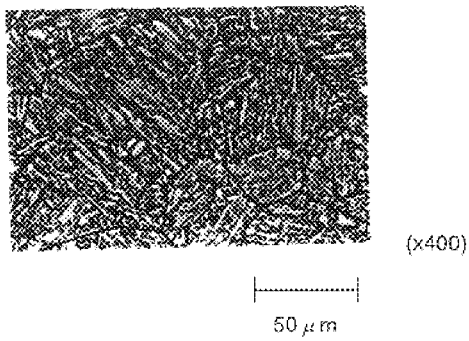
FIG. 2A shows an optical micrograph of one example metal microstructure of an invention steel.
Figure 3A:
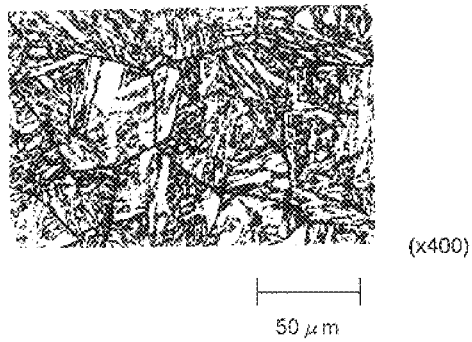
FIG. 3A shows an example of photograph of typical metal microstructure of a comparative steel with a high carbon amount.
Figure 2B:
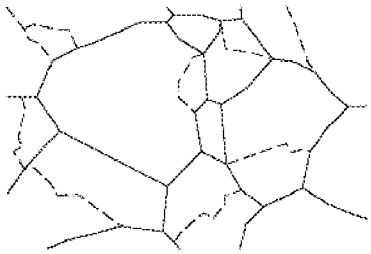
FIG. 2B is a schematic illustration of the photograph of FIG. 2A.
Figure 3B:
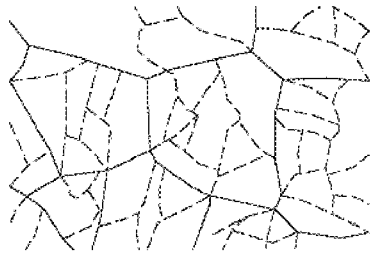
FIG. 3B is a schematic illustration of the photograph of FIG. 3A.

FIG. 2A shows an optical micrograph of the structure of specimen 3 taken with a magnification of 400 as a typical structure of the invention steel. As a comparative example, FIG. 3A shows an optical micrograph of the structure of specimen C1 taken with a magnification of 400 and its sketch. In specimen C1 in which the carbon amount is high, the packet size is obviously small. In other words, the deterioration of machinability has a correlation to the packet size shown in Table 3 and it can be concluded that the packet size decreased in comparative specimen C1 with a high carbon amount, resulting in the deterioration of machinability.

In comparative specimen C2 in which the nitrogen amount is higher than the specified range of the invention, the polishing property, which is an important property for die steels, was inferior to the specimens of the invention and undesirable chipping occurred also in the machinability test.

Figure 4:
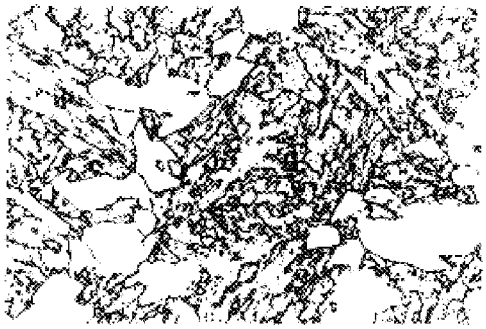
FIG. 4 shows an example of photograph of typical metal microstructure of a comparative steel with a low Cr amount and its schematic illustration of the photograph of FIG. 2A.

FIG. 4 shows a photograph of the structure of comparative specimen C3 with a low Cr amount taken with a magnification of 400. As shown in FIG. 4, the ferrite structure develops when the Cr amount is lower than the specified range of the invention. This formation of ferrite causes deterioration in machinability.

TABLE 2-continued

| Specimen | Chemical composition Wt. % | | | | | | |
|---|---|---|---|---|---|---|---|
| No. | H | P | B | W | Ti | Zr | Remarks |
| 6 | 0.0003 | 0.022 | 0.0013 | 0.01 | 0.004 | 0.006 | Invention steel |
| 7 | 0.0004 | 0.013 | 0.0009 | 0.01 | 0.003 | 0.005 | Invention steel |
| 8 | 0.0003 | 0.025 | 0.0048 | 0.01 | 0.002 | 0.004 | Invention steel |
| 9 | 0.0003 | 0.024 | 0.0010 | 0.01 | 0.006 | 0.005 | Invention steel |
| 10 | 0.0002 | 0.012 | 0.0011 | 0.01 | 0.005 | 0.006 | Invention steel |

TABLE 1

| Specimen | Chemical composition wt. % | | | | | | | | | | | | | | | |
|---|---|---|---|---|---|---|---|---|---|---|---|---|---|---|---|---|
| No. | C | Si | Mn | Cr | Ni | Al | Cu | Mo | Co | V | Nb | N | O | S | Fe | Remarks |
| 1 | 0.031 | 0.28 | 0.31 | 3.22 | 2.98 | 1.05 | 1.45 | 0.31 | 0.01 | 0.043 | 0.004 | 0.0054 | 0.0016 | 0.004 | bal. | Invention steel |
| 2 | 0.031 | 0.30 | 0.32 | 4.05 | 3.01 | 1.10 | 1.50 | 0.30 | 0.01 | 0.055 | 0.004 | 0.0060 | 0.0017 | 0.004 | bal. | Invention steel |
| 3 | 0.029 | 0.30 | 0.29 | 5.01 | 3.01 | 1.02 | 1.45 | 0.32 | 0.01 | 0.056 | 0.004 | 0.0052 | 0.0017 | 0.005 | bal. | Invention steel |
| 4 | 0.028 | 0.29 | 0.28 | 5.99 | 3.05 | 1.03 | 1.46 | 0.33 | 0.01 | 0.049 | 0.004 | 0.0054 | 0.0019 | 0.005 | bal. | Invention steel |
| 5 | 0.030 | 0.28 | 0.31 | 7.12 | 2.99 | 1.10 | 1.51 | 0.28 | 0.01 | 0.044 | 0.005 | 0.0055 | 0.0018 | 0.004 | bal. | Invention steel |
| 6 | 0.031 | 0.31 | 0.30 | 7.85 | 2.89 | 1.05 | 1.48 | 0.35 | 0.01 | 0.044 | 0.004 | 0.0050 | 0.0020 | 0.005 | bal. | Invention steel |
| 7 | 0.006 | 0.28 | 0.31 | 5.11 | 2.98 | 1.10 | 1.48 | 0.30 | 0.01 | 0.048 | 0.004 | 0.0051 | 0.0014 | 0.004 | bal. | Invention steel |
| 8 | 0.015 | 0.29 | 0.32 | 5.09 | 3.01 | 1.11 | 1.51 | 0.31 | 0.01 | 0.042 | 0.004 | 0.0060 | 0.0018 | 0.004 | bal. | Invention steel |
| 9 | 0.032 | 0.28 | 0.29 | 4.99 | 3.01 | 1.08 | 1.48 | 0.33 | 0.01 | 0.042 | 0.004 | 0.0058 | 0.0016 | 0.005 | bal. | Invention steel |
| 10 | 0.062 | 0.29 | 0.28 | 5.01 | 3.05 | 1.00 | 1.49 | 0.34 | 0.01 | 0.054 | 0.004 | 0.0054 | 0.0015 | 0.005 | bal. | Invention steel |
| 11 | 0.083 | 0.29 | 0.31 | 5.02 | 2.99 | 1.02 | 1.52 | 0.35 | 0.01 | 0.060 | 0.005 | 0.0054 | 0.0018 | 0.004 | bal. | Invention steel |
| 12 | 0.100 | 0.29 | 0.30 | 5.10 | 2.89 | 1.12 | 1.49 | 0.32 | 0.01 | 0.049 | 0.004 | 0.0052 | 0.0020 | 0.005 | bal. | Invention steel |
| C1 | 0.142 | 0.30 | 0.30 | 5.11 | 3.10 | 1.12 | 1.52 | 0.32 | 0.01 | 0.050 | 0.005 | 0.0062 | 0.0013 | 0.004 | bal. | Comparative steel |
| C2 | 0.028 | 0.29 | 0.30 | 5.02 | 3.01 | 1.10 | 1.50 | 0.33 | 0.01 | 0.048 | 0.005 | 0.0322 | 0.0015 | 0.005 | bal. | Comparative steel |
| C3 | 0.030 | 0.30 | 0.29 | 2.49 | 2.99 | 1.09 | 1.48 | 0.29 | 0.01 | 0.037 | 0.004 | 0.0063 | 0.0016 | 0.005 | bal. | Comparative steel |
| C4 | 0.031 | 0.28 | 0.31 | 8.45 | 3.03 | 1.10 | 1.51 | 0.34 | 0.01 | 0.044 | 9.004 | 0.0061 | 0.0014 | 0.004 | bal. | Comparative steel |

TABLE 2

| Specimen | Chemical composition Wt. % | | | | | | |
|---|---|---|---|---|---|---|---|
| No. | H | P | B | W | Ti | Zr | Remarks |
| 1 | 0.0003 | 0.013 | 0.0009 | 0.01 | 0.006 | 0.002 | Invention steel |
| 2 | 0.0002 | 0.013 | 0.0038 | 0.01 | 0.005 | 0.003 | Invention steel |
| 3 | 0.0003 | 0.011 | 0.0010 | 0.01 | 0.006 | 0.005 | Invention steel |
| 4 | 0.0002 | 0.003 | 0.0011 | 0.01 | 0.004 | 0.004 | Invention steel |
| 5 | 0.0004 | 0.012 | 0.0008 | 0.01 | 0.002 | 0.005 | Invention steel |

TABLE 2-continued

| Specimen | Chemical composition Wt. % | | | | | | |
|---|---|---|---|---|---|---|---|
| No. | H | P | B | W | Ti | Zr | Remarks |
| 11 | 0.0003 | 0.022 | 0.0008 | 0.01 | 0.006 | 0.005 | Invention steel |
| 12 | 0.0002 | 0.014 | 0.0009 | 0.01 | 0.004 | 0.604 | Invention steel |
| C1 | 0.0004 | 0.024 | 0.0012 | 0.01 | 0.006 | 0.005 | Comparative steel |
| C2 | 0.0003 | 0.022 | 0.0038 | 0.01 | 0.005 | 0.006 | Comparative steel |
| C3 | 0.0004 | 0.012 | 0.0011 | 0.01 | 0.006 | 0.005 | Comparative steel |

TABLE 2-continued

| Specimen No. | Chemical composition Wt. % H | P | B | W | Ti | Zr | Remarks |
|---|---|---|---|---|---|---|---|
| C4 | 0.0003 | 0.025 | 0.0013 | 0.01 | 0.004 | 0.004 | Comparative steel |

Upper limit values of impurities based on measured levels
0.001 Mg, 0.001 Ca, 0.001 Ag, 0.001 Zn, 0.006 Sn, 0.001 Pb, 0.004 As, 0.001 Sb, 0.01 Bi, 0.01 Se, 0.001 Te, 0.01 Y, 0.01 Ce and 0.01 Ta Moreover, the combined addition of Mo and Co as with specimen No. 24 can further improve toughness and is advantageous.

In comparative steels C5 to C7 to which Mo and/or Co was added in amounts in excess of the desirable composition ranges of the invention, it is confirmed that machinability is deteriorated although an improvement in toughness can be achieved.

The metal microstructures of specimen No. 21 (Mo and Co are not added), specimen No. 22 (Mo is added), Specimen No. 23 (Co is added) and specimen No. 24 (combined addition of O and Mo) of the invention, which were observed after the etching treatment to make carbides at grain-boundaries conspicuously visible, are shown in FIG. 5, FIG. 6, FIG. 7 and FIG. 8, respectively.

TABLE 3

| Specimen No. | Packet size of martensite | Hardness HRC | Corrosion resistance Tap-water immersion | Salt spray | Machin-ability | Toughness J/cm$^2$ | Polishing property | Remarks |
|---|---|---|---|---|---|---|---|---|
| 1 | 8 | 40.2 | ◎ | ○ | 0.17 | 24.0 | ○ | Invention steel |
| 2 | 8 | 40.5 | ◎ | ○ | 0.15 | 24.2 | ○ | Invention steel |
| 3 | 8 | 40.3 | ◎ | ○ | 0.14 | 23.8 | ○ | Invention steel |
| 4 | 8 | 40.5 | ◎ | ○ | 0.14 | 24.0 | ○ | Invention steel |
| 5 | 8 | 40.6 | ◎ | ◎ | 0.14 | 24.0 | ○ | Invention steel |
| 6 | 8 | 40.3 | ◎ | ◎ | 0.15 | 24.3 | ○ | Invention steel |
| 7 | 7 | 40.2 | ◎ | ○ | 0.13 | 23.8 | ○ | Invention steel |
| 8 | 7.5 | 40.3 | ◎ | ○ | 0.13 | 23.9 | ○ | Invention steel |
| 9 | 8 | 40.5 | ◎ | ○ | 0.14 | 24.2 | ○ | Invention steel |
| 10 | 8 | 41 | ◎ | ○ | 0.15 | 24.2 | ○ | Invention steel |
| 11 | 8 | 40.9 | ◎ | ○ | 0.17 | 24.0 | ○ | Invention steel |
| 12 | 8 | 41.1 | ◎ | ○ | 0.17 | 24.3 | ○ | Invention steel |
| C1 | 9.5 | 41.2 | ◎ | Δ | 0.40 | 8.6 | ○ | Comparative steel |
| C2 | 8 | 41 | ◎ | ○ | × (Chipping) | 6.8 | × | Comparative steel |
| C3 | Ferrite | 39.8 | × | × | 0.37 | 24.8 | ○ | Comparative steel |
| C4 | Ferrite | 39.7 | ◎ | ◎ | 0.35 | 25.2 | ○ | Comparative steel |

Example 2

Steels which have the main components shown in Table 4 and in which the trace elements shown in Table 5 are detectable were produced by the above manufacturing method and their properties were evaluated. The results of the evaluation are shown in Table 6.

In specimens Nos. 21 to 24, the effects of the addition of Mo and Co in the desirable specified ranges of the invention were confirmed. Specimens Nos. 22 to 24 to which Mo and/or Co is added show dramatically improved toughness in comparison with specimen No. 21 to which Co is not substantially added and their machinability is not scarcely deteriorated. In other words, it is apparent that the addition of Co and Mo is very effective in improving toughness.

Figure 5:
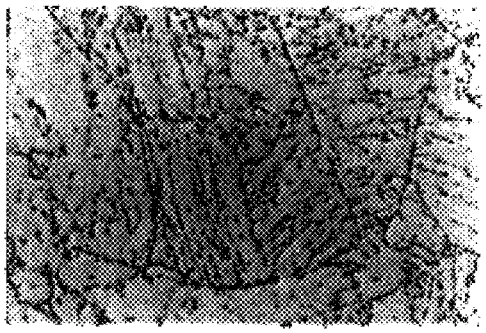
FIG. 5 shows one example of photograph of metal microstructure of an invention steel, in which photograph the carbides at the grain boundaries are made conspicuously visible.
Figure 6:
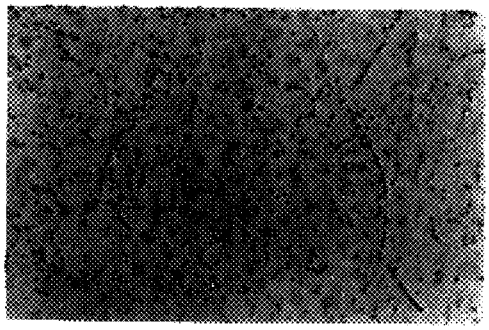
FIG. 6 shows an example of photograph of metal microstructure of an invention steel to which Mo is added, in which photograph the carbides at the grain boundaries are made conspicuously visible.
Figure 7:
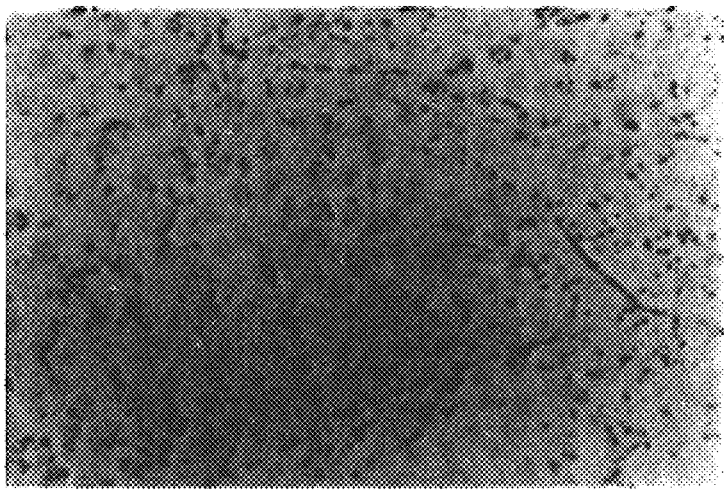
FIG. 7 shows an example of photograph of metal microstructure of an invention steel to which Co is added, in which photograph the carbides at the grain boundaries are made conspicuously visible.
Figure 8:
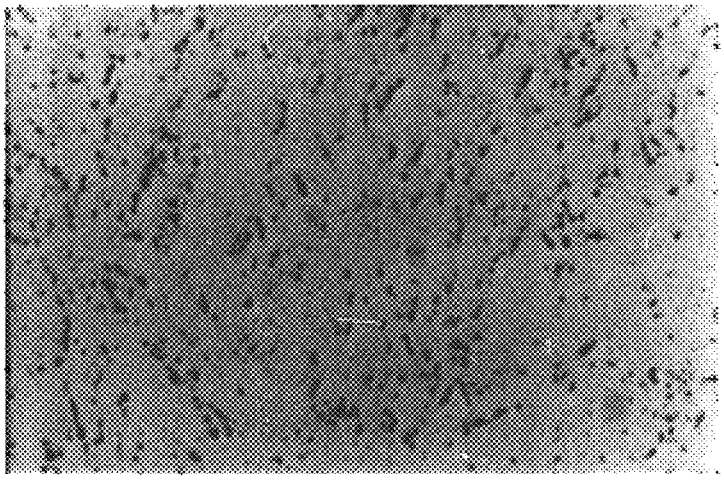
FIG. 8 shows one example of photograph of metal microstructure of an invention steel to which Mo and Co are added in combination, in which photograph the carbides at the grain boundaries are made conspicuously visible.

It is apparent that in the steel not comprising Mo and Co shown in FIG. 5, carbides ($M_7C_3$) precipitate in large amounts at the prior-austenite grain boundaries and the packet boundaries of martensite in spite of a low C amount. On the other hand, it can be ascertained that in the steels containing Mo and/or Co shown in FIGS. 6 and 8, the amount of carbides ($M_7C_3$) which precipitate at the prior-austenite grain boundaries and the packet boundaries of martensite decreases considerably. In other words, it is clear that the addition of Mo and/or Co in the present invention is very effective in restraining the carbides ($M_7C_3$) precipitating at the prior-austenite grain boundaries and the packet boundaries of martensite, which carbides cause the deterioration of toughness.

TABLE 4

| Specimen | Chemical composition wt. % | | | | | | | | | | | | | | | |
|---|---|---|---|---|---|---|---|---|---|---|---|---|---|---|---|---|
| No. | C | Si | Mn | Cr | Ni | Al | Cu | Mo | Co | V | Nb | N | O | S | Fe | Remarks |
| 21 | 0.029 | 0.30 | 0.30 | 5.02 | 3.10 | 1.08 | 1.48 | 0.01 | 0.01 | 0.005 | 0.005 | 0.0050 | 0.0013 | 0.004 | bal. | Invention steel |
| 22 | 0.028 | 0.29 | 0.30 | 5.10 | 3.01 | 1.10 | 1.50 | 0.30 | 0.01 | 0.004 | 0.005 | 0.0045 | 0.0015 | 0.005 | bal. | Invention steel |
| 23 | 0.030 | 0.30 | 0.29 | 5.05 | 2.99 | 1.09 | 1.48 | 0.01 | 0.34 | 0.005 | 0.004 | 0.0048 | 0.0016 | 0.005 | bal. | Invention steel |
| 24 | 0.031 | 0.28 | 0.31 | 5.12 | 3.03 | 1.10 | 1.51 | 0.35 | 0.36 | 0.005 | 0.004 | 0.0047 | 0.0014 | 0.004 | bal. | Invention steel |
| C5 | 0.031 | 0.28 | 0.31 | 5.12 | 2.98 | 1.05 | 1.45 | 1.68 | 0.01 | 0.005 | 0.004 | 0.0054 | 0.0016 | 0.004 | bal. | Comparative steel |
| C6 | 0.031 | 0.30 | 0.32 | 4.99 | 3.01 | 1.10 | 1.52 | 0.01 | 1.65 | 0.005 | 0.004 | 0.0060 | 0.0017 | 0.004 | bal. | Comparative steel |
| C7 | 0.029 | 0.30 | 0.29 | 5.01 | 3.01 | 1.02 | 1.45 | 1.48 | 1.52 | 0.004 | 0.004 | 0.0052 | 0.0017 | 0.005 | bal. | Comparative steel |

TABLE 5

| Specimen | Chemical composition Wt. % | | | | | | |
|---|---|---|---|---|---|---|---|
| No. | H | P | B | W | Ti | Zr | Remarks |
| 21 | 0.0003 | 0.025 | 0.0013 | 0.01 | 0.004 | 0.004 | Invention steel |
| 22 | 0.0003 | 0.013 | 0.0009 | 0.01 | 0.006 | 0.002 | Invention steel |
| 23 | 0.0002 | 0.013 | 0.0038 | 0.01 | 0.005 | 0.003 | Invention steel |
| 24 | 0.0003 | 0.011 | 0.0010 | 0.01 | 0.006 | 0.005 | Invention steel |
| C5 | 0.0002 | 0.003 | 0.0011 | 0.01 | 0.004 | 0.004 | Comparative steel |
| C6 | 0.0004 | 0.012 | 0.0008 | 0.01 | 0.002 | 0.005 | Comparative steel |
| C7 | 0.0003 | 0.022 | 0.0013 | 0.01 | 0.004 | 0.006 | Comparative steel |

Upper limit values of impurities based on measured levels
0.001 Mg, 0.001 Ca, 0.001 Ag, 0.001 Zn, 0.006 Sn, 0.001 Pb, 0.004 As, 0.001 Sb, 0.01 Bi, 0.01 Se, 0.001 Te, 0.01 Y, 0.01 Ce and 0.01 Ta

Example 3

Steels which have the main components shown in Table 7 and in which the trace elements shown in Table 8 are detectable were produced by the above manufacturing method and their properties were evaluated. The results of the evaluation are shown in Table 9.

In specimens Nos. 31 to 35, the effects of the addition of V and Nb in the desirable specified ranges of the invention were confirmed. Specimens Nos. 32 to 35 to which V and/or Nb is added show dramatically improved toughness in comparison with specimen No. 31 to which V or Nb is not substantially added and their machinability was not scarcely deteriorated. In other words, it is apparent that the addition of V and Nb is very effective in improving toughness. Moreover, the combined addition of v and Nb as with Specimen No. 34 is possible.

In comparative steels C8 to C10 to which V and/or Nb was added in amounts in excess of the desirable composition ranges of the present invention, it is confirmed that toughness was not scarcely improved, that machinability was deteriorated, and that corrosion resistance was also deteriorated.

TABLE 6

| Specimen No. | Packet size of martensitic micro-structure | Hardness HRC | Corrosion resistance: Tap-water immersion | Corrosion resistance: Salt spray | Machin-ability | Toughness J/cm$^2$ | Polishing property | Remarks |
|---|---|---|---|---|---|---|---|---|
| 21 | 8 | 40.2 | ◎ | ○ | 0.14 | 13.6 | ○ | Invention steel |
| 22 | 8 | 41.0 | ◎ | ○ | 0.15 | 20.4 | ○ | Invention steel |
| 23 | 8 | 41.0 | ◎ | ○ | 0.15 | 20.0 | ○ | Invention steel |
| 24 | 8 | 41.2 | ◎ | ○ | 0.16 | 28.4 | ○ | Invention steel |
| C5 | 8 | 40.2 | ◎ | ○ | 0.28 | 21.0 | ○ | Comparative steel |
| C6 | 8 | 40.5 | ◎ | ○ | 0.30 | 21.3 | ○ | Comparative steel |
| C7 | 8 | 40.3 | ◎ | ○ | 0.31 | 25.1 | ○ | Comparative steel |

TABLE 7

| Specimen | Chemical composition wt. % | | | | | | | | | | | | | | | |
|---|---|---|---|---|---|---|---|---|---|---|---|---|---|---|---|---|
| No. | C | Si | Mn | Cr | Ni | Al | Cu | Mo | Co | V | Nb | N | O | S | Fe | Remarks |
| 31 | 0.029 | 0.30 | 0.30 | 5.02 | 3.10 | 1.08 | 1.48 | 0.01 | 0.01 | 0.005 | 0.005 | 0.0050 | 0.0013 | 0.004 | bal. | Invention steel |
| 32 | 0.028 | 0.29 | 0.30 | 5.10 | 3.01 | 1.10 | 1.50 | 0.01 | 0.01 | 0.060 | 0.005 | 0.0045 | 0.0015 | 0.005 | bal. | Invention steel |
| 33 | 0.030 | 0.30 | 0.29 | 5.05 | 2.99 | 1.09 | 1.48 | 0.01 | 0.01 | 0.005 | 0.040 | 0.0048 | 0.0016 | 0.005 | bal. | Invention steel |
| 34 | 0.031 | 0.28 | 0.31 | 5.12 | 3.03 | 1.10 | 1.51 | 0.01 | 0.01 | 0.080 | 0.080 | 0.0047 | 0.0014 | 0.004 | bal. | Invention steel |
| 35 | 0.029 | 0.29 | 0.29 | 5.03 | 3.00 | 1.04 | 1.53 | 0.32 | 0.31 | 0.040 | 0.005 | 0.0041 | 0.0012 | 0.004 | bal. | Invention steel |
| C8 | 0.031 | 0.28 | 0.31 | 5.12 | 2.98 | 1.05 | 1.45 | 0.01 | 0.01 | 0.710 | 0.004 | 0.0054 | 0.0016 | 0.004 | bal. | Comparative steel |
| C9 | 0.031 | 0.30 | 0.32 | 4.99 | 3.01 | 1.10 | 1.52 | 0.01 | 0.01 | 0.005 | 0.620 | 0.0060 | 0.0017 | 0.004 | bal. | Comparative steel |
| C10 | 0.029 | 0.30 | 0.29 | 5.01 | 3.01 | 1.02 | 1.45 | 0.01 | 0.01 | 0.360 | 0.320 | 0.0052 | 0.0017 | 0.005 | bal. | Comparative steel |

TABLE 8

| Specimen | Chemical composition Wt. % | | | | | | |
|---|---|---|---|---|---|---|---|
| No. | H | P | B | W | Ti | Zr | Remarks |
| 31 | 0.0002 | 0.003 | 0.0011 | 0.01 | 0.004 | 0.004 | Invention steel |
| 32 | 0.0004 | 0.012 | 0.0008 | 0.01 | 0.002 | 0.005 | Invention steel |
| 33 | 0.0003 | 0.022 | 0.0013 | 0.01 | 0.004 | 0.006 | Invention steel |
| 34 | 0.0004 | 0.013 | 0.0009 | 0.01 | 0.003 | 0.005 | Invention steel |
| 35 | 0.0004 | 0.024 | 0.0008 | 0.01 | 0.003 | 0.004 | Invention steel |

TABLE 8-continued

| Specimen | Chemical composition Wt. % | | | | | | |
|---|---|---|---|---|---|---|---|
| No. | H | P | B | W | Ti | Zr | Remarks |
| C8 | 0.0003 | 0.025 | 0.0048 | 0.01 | 0.002 | 0.004 | Comparative steel |
| C9 | 0.0003 | 0.024 | 0.0010 | 0.01 | 0.006 | 0.005 | Comparative steel |
| C10 | 0.0002 | 0.012 | 0.0011 | 0.01 | 0.005 | 0.006 | Comparative steel |

Upper limit values of impurities based on measured levels 0.001 Mg, 0.001 Ca, 0.001 Ag, 0.001 Zn, 0.006 Sn, 0.001 Pb, 0.004 As, 0.001 Sb, 0.01 Bi, 0.01 Se, 0.001 Te, 0.01 Y, 0.01 Ce and 0.01 Ta

TABLE 9

| Specimen No. | Packet size of martensitic micro-structure | Hardness HRC | Corrosion resistance: Tap-water immersion | Corrosion resistance: Salt spray | Machin-ability | Toughness J/cm$^2$ | Polishing property | Remarks |
|---|---|---|---|---|---|---|---|---|
| 31 | 8 | 40.2 | ◎ | ○ | 0.14 | 13.6 | ○ | Invention steel |
| 32 | 8 | 41.0 | ◎ | ○ | 0.17 | 22.4 | ○ | Invention steel |
| 33 | 8 | 41.0 | ◎ | ○ | 0.17 | 23.0 | ○ | Invention steel |
| 34 | 8 | 41.2 | ◎ | ○ | 0.17 | 26.4 | ○ | Invention steel |
| 35 | 8 | 41.3 | ◎ | ○ | 0.17 | 29.4 | ○ | Invention steel |
| C8 | 8 | 41.3 | ◎ | Δ | 0.29 | 17.8 | ○ | Comparative steel |
| C9 | 8 | 41.2 | ◎ | Δ | 0.30 | 16.5 | ○ | Comparative steel |
| C10 | 8 | 41.7 | ◎ | Δ | 0.37 | 15.7 | ○ | Comparative steel |

Example 4

Steels which have the main components shown in Table 10 and in which the trace elements shown in Table 11 are detectable were produced by the above manufacturing method and their properties were evaluated. The results of the evaluation are shown in Table 12.

In specimens Nos. 41 to 51 of the invention, their compositions were varied within the specified ranges of the invention. In contrast to the specimens of the invention, comparative steel C11 has an Si amount exceeding the desirable composition range and, therefore, toughness was deteriorated although machinability improves a little. In comparative steel C12, machinability was remarkably deteriorated although toughness is not improved so much because of an excess amount of Ni.

In comparative steel C13, the Al amount was too small and hardness could not be increased because of the insufficient precipitation hardening element. In comparative steel C15, the Cu amount was excess and cracks occurred during hot working, making working impossible. In comparative steel C15 whose sulfur amount exceeds the desirable composition range, toughness deteriorated remarkably because of the sulfur amount although machinability was improved. Moreover, because sulfides were formed in a large amount, the steel became apt to rust and the polishing property was also deteriorated.

TABLE 11

| Specimen | Chemical composition Wt. % | | | | | | |
|---|---|---|---|---|---|---|---|
| No. | H | P | B | W | Ti | Zr | Remarks |
| 41 | 0.0002 | 0.013 | 0.0038 | 0.01 | 0.005 | 0.003 | Invention steel |
| 42 | 0.0003 | 0.011 | 0.0010 | 0.01 | 0.006 | 0.005 | Invention steel |
| 43 | 0.0002 | 0.003 | 0.0011 | 0.01 | 0.004 | 0.004 | Invention steel |
| 44 | 0.0004 | 0.012 | 0.0008 | 0.01 | 0.002 | 0.005 | Invention steel |
| 45 | 0.0003 | 0.022 | 0.0013 | 0.01 | 0.004 | 0.006 | Invention steel |
| 46 | 0.0004 | 0.013 | 0.0009 | 0.01 | 0.003 | 0.005 | Invention steel |
| 47 | 0.0003 | 0.025 | 0.0048 | 0.01 | 0.002 | 0.004 | Invention steel |
| 48 | 0.0003 | 0.024 | 0.0010 | 0.01 | 0.006 | 0.005 | Invention steel |
| 49 | 0.0002 | 0.012 | 0.0011 | 0.01 | 0.005 | 0.006 | Invention steel |
| 50 | 0.0003 | 0.022 | 0.0008 | 0.01 | 0.006 | 0.005 | Invention steel |
| 51 | 0.0002 | 0.014 | 0.0009 | 0.01 | 0.004 | 0.004 | Invention steel |
| C11 | 0.0004 | 0.024 | 0.0012 | 0.01 | 0.006 | 0.005 | Comparative steel |

TABLE 10

| Specimen | Chemical composition wt. % | | | | | | | | | | | | | | | |
|---|---|---|---|---|---|---|---|---|---|---|---|---|---|---|---|---|
| No. | C | Si | Mn | Cr | Ni | Al | Cu | Mo | Co | V | Nb | N | O | S | Fe | Remarks |
| 41 | 0.032 | 1.20 | 1.45 | 5.56 | 3.46 | 0.89 | 1.46 | 0.01 | 0.01 | 0.050 | 0.004 | 0.0060 | 0.0017 | 0.004 | bal. | Invention steel |
| 42 | 0.062 | 0.89 | 0.31 | 6.61 | 2.56 | 1.56 | 1.06 | 0.33 | 0.01 | 0.004 | 0.004 | 0.0026 | 0.0017 | 0.005 | bal. | Invention steel |
| 43 | 0.029 | 0.34 | 0.56 | 5.88 | 2.98 | 1.46 | 1.12 | 0.01 | 0.01 | 0.005 | 0.004 | 0.0054 | 0.0019 | 0.005 | bal. | Invention steel |
| 44 | 0.046 | 0.77 | 1.11 | 3.21 | 1.88 | 0.78 | 1.78 | 0.01 | 0.01 | 0.005 | 0.005 | 0.0055 | 0.0018 | 0.004 | bal. | Invention steel |
| 45 | 0.058 | 0.56 | 0.78 | 4.65 | 3.04 | 0.69 | 3.20 | 0.01 | 0.01 | 0.004 | 0.004 | 0.0050 | 0.0020 | 0.005 | bal. | Invention steel |
| 46 | 0.019 | 1.03 | 0.91 | 1.77 | 1.78 | 1.23 | 0.99 | 0.01 | 0.01 | 0.005 | 0.004 | 0.0051 | 0.0014 | 0.004 | bal. | Invention steel |
| 47 | 0.095 | 0.28 | 0.21 | 5.36 | 2.16 | 1.64 | 1.78 | 0.01 | 0.01 | 0.005 | 0.004 | 0.0018 | 0.0018 | 0.004 | bal. | Invention steel |
| 48 | 0.027 | 0.68 | 0.19 | 5.46 | 3.46 | 0.88 | 2.33 | 0.01 | 0.01 | 0.004 | 0.004 | 0.0058 | 0.0016 | 0.005 | bal. | Invention steel |
| 49 | 0.038 | 0.99 | 1.87 | 3.15 | 1.79 | 1.86 | 1.44 | 0.01 | 0.01 | 0.005 | 0.004 | 0.0054 | 0.0015 | 0.005 | bal. | Invention steel |
| 50 | 0.049 | 0.45 | 0.67 | 6.66 | 2.66 | 1.44 | 1.56 | 0.01 | 0.01 | 0.005 | 0.005 | 0.0054 | 0.0018 | 0.004 | bal. | Invention steel |
| 51 | 0.021 | 0.31 | 0.22 | 4.65 | 3.75 | 1.18 | 3.02 | 0.01 | 0.01 | 0.004 | 0.004 | 0.0052 | 0.0020 | 0.005 | bal. | Invention steel |
| C11 | 0.026 | 2.20 | 0.35 | 7.56 | 2.03 | 0.89 | 2.03 | 0.01 | 0.01 | 0.005 | 0.005 | 0.0050 | 0.0013 | 0.004 | bal. | Comparative steel |
| C12 | 0.043 | 0.62 | 0.38 | 6.23 | 5.36 | 1.56 | 1.89 | 0.01 | 0.01 | 0.004 | 0.005 | 0.0045 | 0.0015 | 0.005 | bal. | Comparative steel |
| C13 | 0.034 | 0.37 | 1.02 | 5.16 | 3.56 | 0.04 | 3.20 | 0.01 | 0.01 | 0.005 | 0.004 | 0.0048 | 0.0016 | 0.005 | bal. | Comparative steel |
| C14 | 0.058 | 0.87 | 0.48 | 4.62 | 1.89 | 1.69 | 4.66 | 0.01 | 0.01 | 0.005 | 0.004 | 0.0047 | 0.0014 | 0.004 | bal. | Comparative steel |
| C15 | 0.068 | 0.99 | 0.79 | 5.88 | 2.47 | 1.74 | 2.64 | 0.01 | 0.01 | 0.005 | 0.004 | 0.0054 | 0.0016 | 0.420 | bal. | Comparative steel |

TABLE 11-continued

| Specimen | Chemical composition Wt. % | | | | | | |
|---|---|---|---|---|---|---|---|
| No. | H | P | B | W | Ti | Zr | Remarks |
| C12 | 0.0003 | 0.022 | 0.0038 | 0.01 | 0.005 | 0.006 | Comparative steel |
| C13 | 0.0004 | 0.012 | 0.0011 | 0.01 | 0.006 | 0.005 | Comparative steel |
| C14 | 0.0003 | 0.025 | 0.0013 | 0.01 | 0.004 | 0.004 | Comparative steel |
| C15 | 0.0003 | 0.013 | 0.0009 | 0.01 | 0.006 | 0.002 | Comparative steel |

Upper limit values of impurities based on measured levels
0.001 Mg, 0.001 Ca, 0.001 Ag, 0.001 Zn, 0.006 Sn, 0.001 Pb, 0.004 As, 0.001 Sb, 0.01 Bi, 0.01 Se, 0.001 Te, 0.01 Y, 0.01 Ce and 0.01 Ta The center cutting method was adopted and the area of cut into a stock to be cut per tool tooth was 240 $mm^2$.

To evaluate the electro-spark machining property, observations directly and with an optical microscope and surface roughness measurement were carried out after the test was performed with the aid of Cu electrodes of 10 to 20 mm in diameter under the conditions that enabled a finished surface (surface roughness) of ±1 $\mu$m to be obtained (peak current: 1 to 4 A, pulse width: 2 to 10 $\mu$s, with kerosene). In evaluating the electro-spark machining property, specimens in which cracks were observed directly and with an optical microscope (×) were first removed. After that, the remaining specimens were rated as follows. Those with surface roughness of less than 2 $\mu$m were rated as good (○), those with surface roughness of 2 to less than 3 $\mu$m as intermediate (Δ), and those with surface roughness of not less than 3 $\mu$m as no good (×).

TABLE 12

| Specimen No. | Packet size of martensite | Hardness HRC | Corrosion resistance: Tap-water immersion | Corrosion resistance: Salt spray | Machin-ability | Toughness J/$cm^2$ | Polishing property | Remarks |
|---|---|---|---|---|---|---|---|---|
| 41 | 8 | 40.5 | ◎ | ○ | 0.15 | 20.2 | ○ | Invention steel |
| 42 | 8 | 40.3 | ◎ | ○ | 0.14 | 29.8 | ○ | Invention steel |
| 43 | 8 | 40.5 | ◎ | ○ | 0.14 | 14 | ○ | Invention steel |
| 44 | 8 | 40.6 | ◎ | ○ | 0.14 | 14 | ○ | Invention steel |
| 45 | 8 | 40.3 | ◎ | ○ | 0.15 | 14.3 | ○ | Invention steel |
| 46 | 8 | 40.2 | ◎ | ◎ | 0.13 | 13.8 | ○ | Invention steel |
| 47 | 8 | 41.3 | ◎ | ○ | 0.13 | 18.9 | ○ | Invention steel |
| 48 | 8 | 40.5 | ◎ | ○ | 0.14 | 14.2 | ○ | Invention steel |
| 49 | 8 | 41 | ◎ | ○ | 0.15 | 14.2 | ○ | Invention steel |
| 50 | 8 | 40.9 | ◎ | ○ | 0.17 | 14 | ○ | Invention steel |
| 51 | 8 | 40.1 | ◎ | ○ | 0.17 | 14.3 | ○ | Invention steel |
| C11 | 8 | 41.2 | ◎ | ○ | 0.13 | 6.8 | ○ | Comparative steel |
| C12 | 8 | 40.1 | ◎ | ○ | 0.26 | 15 | ○ | Comparative steel |
| C13 | 8 | 27.8 | ◎ | ○ | 0.14 | 14.8 | ○ | Comparative steel |
| C14 | Cracks occurred during hot working | | | | | | | Comparative steel |
| C15 | 8 | 40.2 | × | × | 0.13 | 8.6 | × | Comparative steel |

Example 5

Steels which have the main components shown in Table 13 and in which the trace elements shown in Table 14 are detectable were produced by the above manufacturing method and their properties were evaluated. The results of the evaluation are shown in Table 15. In addition to the above evaluation with the aid of an end mill, the machinability in heavy cutting was also evaluated.

To evaluate the machinability in heavy cutting, a face milling cutting test was carried out and the cut length until the tool was damaged was measured. Cutting was performed by the dry method through the use of a single tooth at a cutting speed of 120 m/min and a feed rate of 0.1 mm/tooth.

As shown in Table 15, specimen Nos. 52 to 62 of the invention steel which meet the appropriate ranges obtained by the equation in the invention and have sulfur amounts in the range of from 0.001 to 0.01% endure heavy cutting and develop neither stripe patterns capable of being observed with the naked eye even in precision electric discharging machining nor pits even in the evaluation of the high-grade polishing property. Thus, it is confirmed that these samples are excellent. Moreover, it is confirmed that samples Nos. 52, 54, 55, 57, 58, 60 and 61 which have sulfur amounts of not more than 0.006% provide a better property suitable for precision electric discharging machining and high-grade polishing property.

TABLE 13

| Specimen | Chemical composition wt. % | | | | | | | | | | | | | | | | Value of the |
|---|---|---|---|---|---|---|---|---|---|---|---|---|---|---|---|---|---|
| No. | C | Si | Mn | Cr | Ni | Al | Cu | Mo | Co | V | Nb | N | O | S | Fe | Remarks | equation |
| 52 | 0.0055 | 0.72 | 0.28 | 5.02 | 3.01 | 0.91 | 0.82 | 0.29 | 0.29 | 0.004 | 0.004 | 0.0018 | 0.0017 | 0.0051 | bal. | Invention steel | 3.39062 |
| 53 | 0.058 | 0.29 | 0.29 | 2.98 | 3.98 | 1.14 | 1.00 | 0.29 | 0.01 | 0.004 | 0.004 | 0.0022 | 0.0012 | 0.0100 | bal. | Invention steel | 3.7966 |
| 54 | 0.052 | 0.71 | 0.29 | 5.00 | 2.92 | 0.94 | 0.78 | 0.29 | 0.01 | 0.005 | 0.004 | 0.0017 | 0.0019 | 0.0033 | bal. | Invention steel | 2.85736 |
| 55 | 0.063 | 0.70 | 0.29 | 5.23 | 2.97 | 0.93 | 0.77 | 0.30 | 0.01 | 0.005 | 0.005 | 0.0017 | 0.0012 | 0.0031 | bal. | Invention steel | 2.66582 |
| 56 | 0.061 | 0.72 | 0.49 | 3.95 | 2.97 | 0.88 | 0.81 | 0.30 | 0.01 | 0.004 | 0.004 | 0.0020 | 0.0020 | 0.0081 | bal. | Invention steel | 4.25042 |
| 57 | 0.058 | 1.25 | 0.49 | 3.91 | 2.00 | 1.23 | 0.99 | 0.01 | 0.01 | 0.005 | 0.004 | 0.0051 | 0.0014 | 0.0040 | bal. | Invention steel | 4.2914 |
| 58 | 0.095 | 0.36 | 0.21 | 5.36 | 2.96 | 0.91 | 0.80 | 0.32 | 0.01 | 0.005 | 0.004 | 0.0018 | 0.0018 | 0.0041 | bal. | Invention steel | 2.63542 |
| 59 | 0.034 | 0.29 | 0.59 | 5.88 | 2.95 | 1.26 | 2.14 | 0.46 | 0.01 | 0.004 | 0.004 | 0.0015 | 0.0016 | 0.0062 | bal. | Invention steel | 2.58124 |
| 60 | 0.063 | 1.18 | 0.49 | 3.93 | 2.95 | 0.90 | 0.81 | 0.47 | 0.01 | 0.005 | 0.004 | 0.0019 | 0.0006 | 0.0038 | bal. | Invention steel | 4.11166 |
| 61 | 0.049 | 0.56 | 0.67 | 6.66 | 2.66 | 1.44 | 1.56 | 0.01 | 0.01 | 0.005 | 0.005 | 0.0020 | 0.0018 | 0.0043 | bal. | Invention steel | 2.77546 |
| 62 | 0.031 | 0.31 | 0.22 | 4.65 | 3.56 | 1.18 | 1.34 | 0.01 | 0.01 | 0.004 | 0.004 | 0.0019 | 0.0020 | 0.0062 | bal. | Invention steel | 2.60214 |
| 63 | 0.033 | 0.29 | 0.30 | 5.08 | 2.95 | 1.00 | 0.96 | 0.30 | 0.01 | 0.110 | 0.005 | 0.0017 | 0.0008 | 0.0006 | bal. | Invention steel | 1.05482 |
| 64 | 0.063 | 0.30 | 0.29 | 5.15 | 2.90 | 0.88 | 0.81 | 0.29 | 0.01 | 0.004 | 0.005 | 0.0020 | 0.0010 | 0.0005 | bal. | Invention steel | 1.2907 |
| 65 | 0.049 | 0.70 | 0.50 | 3.92 | 2.98 | 0.93 | 0.81 | 0.48 | 0.01 | 0.005 | 0.004 | 0.0018 | 0.0016 | 0.0009 | bal. | Invention steel | 2.16138 |
| 66 | 0.033 | 1.45 | 0.49 | 4.56 | 2.98 | 0.88 | 0.91 | 0.48 | 0.01 | 0.004 | 0.004 | 0.0011 | 0.0010 | 0.0150 | bal. | Invention steel | 7.5121 |
| 67 | 0.052 | 1.18 | 0.68 | 4.65 | 3.02 | 0.84 | 0.84 | 0.38 | 0.01 | 0.005 | 0.005 | 0.0017 | 0.0012 | 0.1750 | bal. | Invention | 50.4564 |

TABLE 14

| Specimen | Chemical composition Wt. % | | | | | | |
|---|---|---|---|---|---|---|---|
| No. | H | P | B | W | Ti | Zr | Remarks |
| 52 | 0.0002 | 0.022 | 0.0002 | 0.01 | 0.014 | 0.004 | Invention steel |
| 53 | 0.0003 | 0.026 | 0.0010 | 0.01 | 0.006 | 0.005 | Invention steel |
| 54 | 0.0002 | 0.016 | 0.0011 | 0.01 | 0.005 | 0.003 | Invention steel |
| 55 | 0.0004 | 0.012 | 0.0008 | 0.01 | 0.002 | 0.004 | Invention steel |
| 56 | 0.0003 | 0.015 | 0.0003 | 0.01 | 0.004 | 0.006 | Invention steel |
| 57 | 0.0004 | 0.016 | 0.0009 | 0.01 | 0.003 | 0.003 | Invention steel |
| 58 | 0.0003 | 0.022 | 0.0048 | 0.01 | 0.007 | 0.004 | Invention steel |
| 59 | 0.0003 | 0.013 | 0.0010 | 0.01 | 0.006 | 0.005 | Invention steel |
| 60 | 0.0002 | 0.018 | 0.0011 | 0.01 | 0.005 | 0.004 | Invention steel |
| 61 | 0.0003 | 0.022 | 0.0008 | 0.01 | 0.006 | 0.005 | Invention steel |

TABLE 14-continued

| Specimen | Chemical composition Wt. % | | | | | | |
|---|---|---|---|---|---|---|---|
| No. | H | P | B | W | Ti | Zr | Remarks |
| 62 | 0.0002 | 0.003 | 0.0009 | 0.01 | 0.004 | 0.004 | Invention steel |
| 63 | 0.0004 | 0.003 | 0.0002 | 0.01 | 0.008 | 0.004 | Invention steel |
| 64 | 0.0003 | 0.003 | 0.0001 | 0.01 | 0.005 | 0.006 | Invention steel |
| 65 | 0.0004 | 0.023 | 0.0011 | 0.01 | 0.007 | 0.005 | Invention steel |
| 66 | 0.0003 | 0.026 | 0.0003 | 0.01 | 0.005 | 0.004 | Invention steel |
| 67 | 0.0004 | 0.012 | 0.0001 | 0.01 | 0.006 | 0.002 | Invention steel |

Upper limit values of impurities based on measured levels 0.001 Mg, 0.001 Ca, 0.001 Ag, 0.001 Zn, 0.006 Sn, 0.001 Pb, 0.004 As, 0.001 Sb, 0.01 Bi, 0.01 Se, 0.001 Te, 0.01 Y, 0.01 Ce and 0.01 Ta

TABLE 15

| Specimen No. | Packet size of martensite | Hardness HRC | Corrosion resistance: Tap-water immersion | Corrosion resistance: Salt spray | Machinability | Machinability in heavy cutting | Toughness J/cm$^2$ | Electro-spark machining property | Polishing property | Remarks |
|---|---|---|---|---|---|---|---|---|---|---|
| 52 | 8 | 40.3 | ◎ | ○ | 0.15 | 1.75 | 25.4 | ○ | ○ | Invention steel |
| 53 | 8 | 40.8 | ◎ | ○ | 0.14 | 3 | 32.6 | ○ | ○ | Invention steel |
| 54 | 8 | 40.2 | ◎ | ○ | 0.14 | 2 | 14 | ○ | ○ | Invention steel |
| 55 | 8 | 39.9 | ◎ | ○ | 0.14 | 1.25 | 14 | ○ | ○ | Invention steel |
| 56 | 8 | 40.3 | ◎ | ○ | 0.15 | 1.75 | 25 | ○ | ○ | Invention steel |
| 57 | 8 | 39.8 | ◎ | ○ | 0.13 | 2.25 | 24.9 | ○ | ○ | Invention steel |
| 58 | 8 | 41.3 | ◎ | ○ | 0.13 | 2 | 15.3 | ○ | ○ | Invention steel |
| 59 | 8 | 40.5 | ◎ | ○ | 0.14 | 2.75 | 20.4 | ○ | ○ | Invention steel |
| 60 | 8 | 40.5 | ◎ | ○ | 0.15 | 2.25 | 24.8 | ○ | ○ | Invention steel |
| 61 | 8 | 40.9 | ◎ | ○ | 0.17 | 1.75 | 17.2 | ○ | ○ | Invention steel |
| 62 | 8 | 40.2 | ◎ | ○ | 0.17 | 1.5 | 15.6 | ○ | ○ | Invention steel |
| 63 | 8 | 40.6 | ◎ | ○ | 0.13 | 0.1 | 25 | ○ | ○ | Invention steel |
| 64 | 8 | 41.2 | ◎ | ○ | 0.2 | 0.25 | 18 | ○ | ○ | Invention steel |
| 65 | 8 | 40.5 | ◎ | ○ | 0.14 | 0.25 | 14.8 | ○ | ○ | Invention steel |
| 66 | 8 | 39.8 | ◎ | ○ | 0.13 | 3 | 8.2 | × (stripe pattern) | Δ | Invention steel |
| 67 | 8 | 40 | ◎ | ○ | 0.13 | 2 | 8.6 | × (stripe pattern) | Δ | Invention steel |

According to the invention, in order to dramatically improve workability after heat-treatment of steel which has a metal structure whose primary microstructure is martensite, there is provided a high strength steel for dies which is indispensable for a reduction in the man-hours required for cutting dies from the standpoints of a production cost reduction and the shortening of lead time.

Especially when the desirable composition ranges of the invention are met, the steel is very useful for dies of plastic molding, because it has a hardness in the range of from 38 to 45 HRC without detriment to the excellent balance between strength and ductility, is excellent in corrosion resistance, and has remarkably improved machinability.

What is claimed is:

1. A high strength forged steel for dies having excellent machinability, which consists essentially of, by weight, 0.005 to 0.1% C, from more than 0.05% to 1.5% Si, not more than 2.0% Mn, from 3.0 to less than 8.0% Cr, 1.0 to 4.0% Ni, 0.1 to 2.0% Al, 0.3 to 3.5% Cu, 0.1 to 1.0% Mo, and balance of Fe and unavoidable impurities including nitrogen and oxygen, and which has a metal structure whose primary microstructure is martensite and has a hardness of 35 to 45 HRC, and wherein an average packet size of the martensite is not greater than No. 8, and nitrogen and oxygen as impurities are restricted to amount ranges of not more than 0.02% nitrogen and not more than 0.003% oxygen.

2. A high strength steel according to claim 1, which consists essentially of, by weight, 0.21 to 2.0% Mn.

3. A high strength steel according to claim 2, which consists essentially of, by weight, not more than 0.5% of at least one of V and Nb so that (V+Nb)≦0.5%.

4. A high strength steel according to claim 1, which consists essentially of not more than 1% Co.

5. A high strength steel according to claim 4, which consists essentially of, by weight, not more than 0.5% of at least one of V and Nb so that (V+Nb)≦0.5%.

6. A high strength steel according to claim 1, which consists essentially of, by weight, not more than 0.005% nitrogen and not more than 0.001% oxygen.

7. A high strength steel according to claim 6, which consists essentially of, by weight, not more than 0.5% of at least one of V and Nb so that (V+Nb)≦0.5%.

8. A high strength steel according to claim 1, which consists essentially of, by weight, 0.005 to 0.05% C, from more than 0.05% to 1.5% Si, not more than 2.0% Mn, 3.5 to 7.0% Cr, 1.0 to 4.0 % Ni, 0.5 to 2.0% A, 0.3 to 3.5% Cu, 0.1 to 1.0% Mo and balance of Fe and unavoidable impurities.

9. A high strength steel according to claim 1, which consists essentially of, by weight, not more than 0.5% of at least one of V and Nb so that (V+Nb)≦0.5%.

10. A high strength steel according to claim 1, which consists essentially of, by weight, not more than 0.20% S.

11. A high strength steel according to claim 1, which consists essentially of, by weight, 0.001 to 0.20% S.

12. A high strength steel according to claim 1, which consists essentially of, by weight, 0.001 to 0.01% S.

13. A high strength steel according to claim 1, whose chemical composition meets the following equation:

$$(7.7\times C\ (wt\ \%))+(2.2\times Si\ (wt\ \%))+(271.2\times S\ (wt\ \%))\geqq 2.5.$$

14. A high strength steel according to claim 13, wherein the value of the equation is not more than 6.

15. A high strength steel according to claim 13, which consists essentially of, by weight, not less than 0.03% C and 0.8 to 1.5% Si.

16. A high strength steel according to claim 1, wherein Cr is present in an amount from 3.0 to 7.0%.

* * * * *